US005658096A

United States Patent [19]

Von Känel

[11] Patent Number: 5,658,096

[45] Date of Patent: Aug. 19, 1997

[54] EMBANKMENT ELEMENT FOR STABILIZING OR SUPPORTING A SLOPE

[75] Inventor: Hans Rudolf Von Känel, Oberwangen, Switzerland

[73] Assignee: Sytec Bausystm AG, Bern, Switzerland

[21] Appl. No.: 382,567

[22] Filed: Feb. 2, 1995

[30] Foreign Application Priority Data

Feb. 17, 1994 [CH] Switzerland ..... 472/94-0

[51] Int. Cl.[6] ..... C02D 17/20

[52] U.S. Cl. ..... 405/258; 405/16; 405/262; 405/284; 47/83

[58] Field of Search ..... 405/284, 258, 405/262, 285, 286, 15, 16; 47/665, 83

[56] References Cited

U.S. PATENT DOCUMENTS

| | | | |
|---|---|---|---|
| 4,610,568 | 9/1986 | Koerner | 405/258 X |

FOREIGN PATENT DOCUMENTS

| | | | |
|---|---|---|---|
| 574233 | 12/1993 | European Pat. Off. | 405/284 |
| 3800095 | 7/1989 | Germany . | |
| 3932493 | 4/1991 | Germany | 47/83 |
| 21630 | 2/1982 | Japan | 405/258 |
| 133927 | 8/1982 | Japan | 405/258 |
| 112928 | 6/1985 | Japan | 405/16 |
| 169020 | 7/1989 | Japan | 405/258 |
| 52319 | 2/1992 | Japan | 405/262 |
| 287750 | 11/1993 | Japan | 405/258 |
| 294132 | 10/1994 | Japan | 405/15 |
| 2073281 | 10/1981 | United Kingdom | 405/284 |
| 2167794 | 6/1986 | United Kingdom | 405/16 |

*Primary Examiner*—Carl D. Friedman
*Assistant Examiner*—Aimee E. McTigue
*Attorney, Agent, or Firm*—Rothwell, Figg, Ernst & Kurz

[57] ABSTRACT

The embankment element serves to stabilize a slope. A box element has at least one lateral cultivation surface which is provided with a material layer which promotes the growth of plants. The factory-produced embankment element may be brought to the building site, if need be in an already cultivated state. It comprises a prismatic body (10) having at leat one self-supporting side wall (2). The further side walls (3, 4) are formed by a load-bearing single-piece mat (8) which is provided with through-passages (7) and also encloses the self-supporting side wall (2). The self-supporting side wall (2) and the other side walls (3, 4) enclose, with the interposition of said mat (6), a core (9) consisting of a humus-like composition. The end parts of the mat (8) are connected to one another and may be suspended on a bearing element (12). An essential advantage of such an embankment element (10) consists in the fact that it is factory-made and can be transported to the building site as a finished product, if need be in an already cultivated state.

18 Claims, 1 Drawing Sheet

EMBANKMENT ELEMENT FOR STABILIZING OR SUPPORTING A SLOPE

Figure 1:
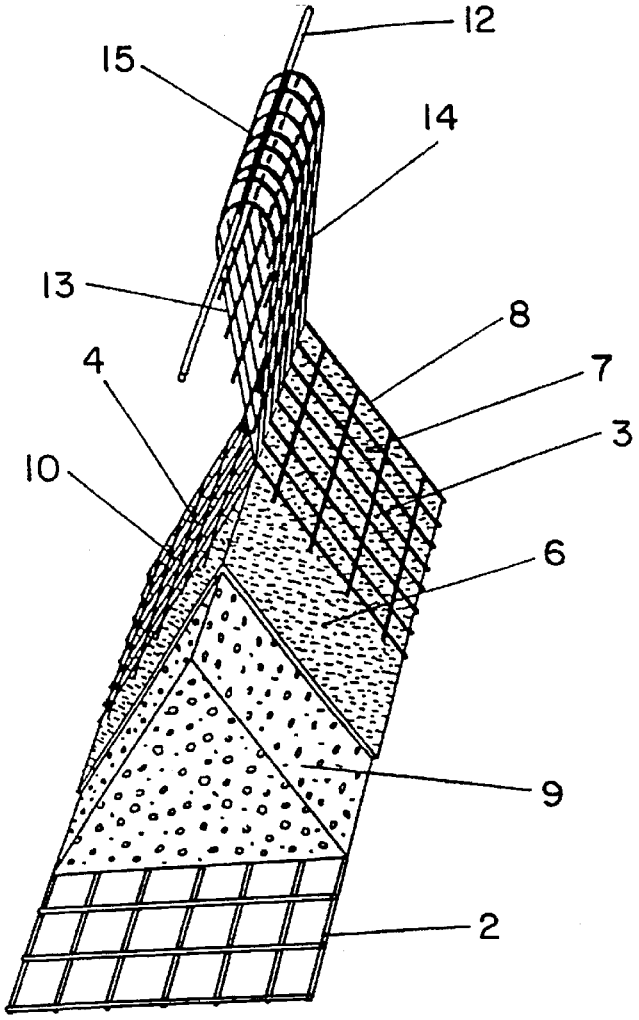

The present invention relates to an embankment element for stabilizing or supporting a slope, having at least one surface with a material layer which promotes the growth of plants.

Various solutions for stabilizing embankments or steep slopes have already been disclosed. There are thus, for example, specially shaped concrete blocks which, arranged in rows and capable of being layered one upon the other, constitute cultivatable tubs. A first type comprises a visible panel, a base wall and two side walls which project rearwards from the panel. Another type is designed as a square box with four side walls without a base.

In contrast, the operation of laying a substrate mat directly on the embankment and anchoring said mat in the slope at intervals in order to stabilize the slope down to considerable depths has also been disclosed. The next substrate mat up in each case is laid, with a lower border part, on said upper end part, penetrating into the slope, and, in accordance with a specific filling height, the upper border part of said mat is also laid in the slope. Relatively great slope heights can thus be covered, in layers, with mats which, by their very nature, can promote the growth of seedlings. Such mats may also be provided with seed grains before they are laid on the slope. It has also already been proposed to cover such mats by means of coconut mats, which are intended to provide climatic conditions which likewise promote growth.

Another proposal is aimed at stabilizing this soft laying method by means of lattices which are known in construction engineering. Accordingly, a structural body is formed, in the case of which the outer side is formed by the lattice which is bent around to the rear at least at its lower border and may possibly be connected rigidly to a second lattice. The angle enclosed by the two lattice parts or lattices can be adapted to the desired embankment angle by wire spacer hooks. The bio-mat is then laid on the lattice and, here too, an end part can be laid in the slope in order to form a supporting body.

DE-A-3800095 discloses a planting element which is intended for cultivating wall surfaces and comprises a box element, of which one wall constitutes an open cultivation surface, and in whose interior a substrate mat is provided. These elements are of identical design and can be fastened on a wall such that they are located one upon the other, with the result that they may also be arranged sideways in rows. Such planting boxes serve to cultivate a wall and, in this form, cannot be used to cultivate steep embankments since they have no possible supporting and/or anchoring means.

The disadvantage with such known slope-stabilizing means is that they have to be constructed on the building site itself and the often sensitive mat, through which plants can grow, can be torn. It has also proved disadvantageous that the embankments formed in this manner often do not grow together very well because, as climatic conditions fluctuate, dry periods alternate with relatively long periods of precipitation, which may hinder the desired cultivation.

It is thus an object of the invention to provide an embankment element which can be produced in a factory and can be brought to the building site, if need be in an already cultivated state.

This object is achieved according to the invention by the features in the characterizing part of claim 1, in that there is provided a prismatic body having at least one self-supporting side wall and having further side walls comprising a load-bearing mat which is provided with through-passages, is designed in one piece and also encloses the self-supporting side wall, in that the self-supporting side wall and the other side walls enclose, with the interposition of said material layer, a core consisting of a humus-like composition, and in that the end parts of the mat are connected to one another and to a bearing element.

Figure 2:
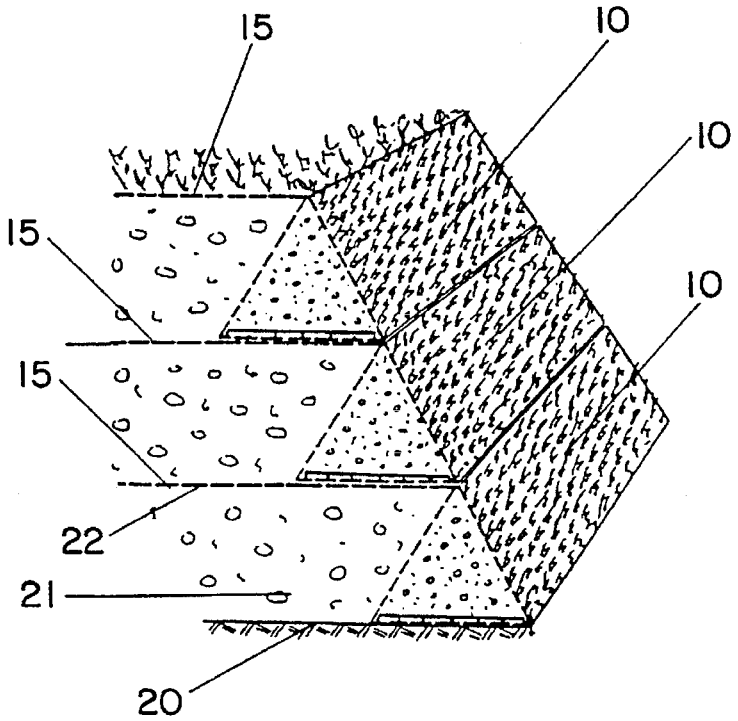

An exemplary embodiment of the invention is explained hereinbelow with reference to a drawing, in which:

FIG. 1 is a perspective representation of the embankment element of the invention, having sections arranged in layers, and FIG. 2 shows a perspective representation of a possible construction of an embankment with the embankment elements of the invention.

The prismatic body 10 in the form of a triangular prism has a self-supporting wall 2, for example comprising a lattice which is known in construction engineering. Located on said wall 2 is a core 7 which is enclosed by a mat 6 and consists of a humus mixture. The two further walls 3, 4 are formed by a lattice mat. Said single-piece lattice mat also encloses the self-supporting wall 2 and is connected, at the prism edge located opposite said self-supporting wall, at the two end parts such that in each case one relatively large projecting part 13, 14 is formed on both sides. The ends of said projecting parts are themselves connected to one another, thus resulting in a strap 15. A bearing element 12, e.g. a bar, can be pushed into such a strap 15, it being possible for the entire embankment element 10 to be lifted up on said bar for the purposes of loading and shifting.

The mat 6 may previously be provided with seeds or said seeds may also be sown in the mat 6 after the embankment element 10 has been formed. In any case, it is possible, using such an element, to keep it in a growth-promoting environment until the seeds at least germinate or, if possible, plants have already grown. Instead of the mat 6, or in addition to the mat 6, turf blocks or cultivated grass sods could also be placed on the core 7.

In order to construct an embankment, a first embankment element 10 may, according to FIG. 2, be laid on a cultivated underlying surface 20 or on an underlying surface which is in the form of a foundation. The backfill 21 may then be progressively introduced behind said embankment element 10. When this backfill 21 has reached the height of the embankment element 10 and forms a plane 22, the strap 15 can be laid out on the plane 22 of the backfill 21 in order thus to form an anchorage between embankment element 10 and backfill 21, and thus to form a supporting body.

The next embankment element 10 is then placed on the compacted backfill 21, it being possible for the visible surface, e.g. the wall 3, either to be in alignment with said wall 3 of the embankment element beneath or to be displaced some way to the rear, depending on the desired steepness of the embankment, which is thus not in every case predetermined not by the angle between the self-supporting wall 2 and the visible wall 3.

The advantage of such an embankment element is obvious. The element can be prefabricated and thus pre-planted or pre-cultivated and then brought to the building site as a finished product. This saves labour time on the building site and thus makes the embankment element much less dependent on the weather than the conventional type of embankment element, in the latter case the construction of the embankment taking place on site, with the result that work has to be carried out in virtually all weathers and there is still the risk of a thunderstorm washing the embankment away.

I claim:

1. A unitary, prefabricated embankment element for stabilizing or supporting a slope comprising:

a prismatic body including at least one self-supporting side wall and at least one additional side wall, said additional side wall being formed of a load bearing mat which encloses said self-supporting side wall;

a core of humus-type composition enclosed by said self-supporting side wall and said additional side wall; and a material layer secured to at least one surface of said prismatic body;

whereby said embankment element constitutes a humus-type-composition-containing unit which is able to be transported from a pre-use location to a location of use substantially in the form in which said embankment element is utilized in stabilizing or supporting said slope.

2. An embankment element according to claim 1, characterized in that the mat is a lattice mat.

3. An embankment element according to claim 2, wherein the prismatic body is a triangular prism.

4. An embankment element according to claim 2, wherein the self-supporting side wall is formed by a lattice.

5. An embankment element according to claim 2, wherein the material layer comprises turf blocks or grass sod disposed on said core.

6. An embankment element according to claim 1, characterized in that the prismatic body is a triangular prism.

7. An embankment element according to claim 6, wherein the self-supporting side wall is formed by a lattice.

8. An embankment element according to claim 6, wherein the material layer comprises turf blocks or grass sod disposed on said core.

9. An element according to claim 1, characterized in that the self-supporting side wall is formed by a lattice.

10. An embankment element according to claim 9, further comprising an integral bearing strap which, when said embankment element is assembled, is located opposite the self-supporting side wall and is disposed exterior to the prismatic body whereby said embankment element may be carried by said bearing strap.

11. An embankment element according to claim 10, further including a bearing element located in the bearing strap.

12. An embankment element according to claim 11, wherein the material layer comprises turf blocks or grass sod disposed on said core.

13. An embankment element according to claim 9, wherein the material layer comprises turf blocks or grass sod disposed on said core.

14. An embankment element according to claim 1, wherein the material layer comprises turf blocks or a grass sod provided on the core.

15. An embankment comprising embankment elements according to claim 1, characterized in that prismatic bodies with different angles at the edge between the self-supporting side wall and one additional side wall are layered one upon the other such that a steeper embankment angle is formed in the lower part of the embankment than in the upper part thereof.

16. An embankment according to claim 15, characterized in that prismatic bodies with base surfaces other than triangular prisms are placed one upon the other.

17. A unitary, prefabricated embankment element for stabilizing or supporting a slope comprising:

a prismatic body including at least one self-supporting side wall formed of a lattice and at least one additional side wall formed of a load bearing mat which encloses said self-supporting side wall, said load bearing mat including a bearing strap portion which, when said embankment element is assembled, is located opposite said self-supporting side wall and is disposed exterior to said prismatic body whereby said embankment element may be carried by means of said bearing strap portion;

a core of a humus-type composition enclosed by said self-supporting side wall and said additional side wall, and a material layer secured to at least one surface of said prismatic body;

whereby said embankment element constitutes a humus-type-composition-containing unit which is able to be transported from a pre-use location to a location of use substantially in the form in which said embankment element is utilized in stabilizing or supporting said slope.

18. An embankment element according to claim 17, wherein the material layer comprises turf blocks or grass sod disposed on said core.

* * * * *

UNITED STATES PATENT AND TRADEMARK OFFICE

CERTIFICATE OF CORRECTION

PATENT NO. : 5,658,096

DATED : August 19, 1997

INVENTOR(S) : Hans Rudolf Von Känel

It is certified that error appears in the above-indentified patent and that said Letters Patent is hereby corrected as shown below:

On the Coversheet: The Assignee's name should be -- Sytec Bausysteme AG --; In the Specification: Col. 2, line 20, "7" should be -- 9 --; Col. 2, line 20, after "by a mat" insert -- or material layer --; In the Claims: Col. 4, line 29 (claim 17), delete "means of".

Signed and Sealed this

FourthDay of August, 1998

Bruce Lehman

*Attest:*

BRUCE LEHMAN

*Attesting Officer*

*Commissioner of Patents and Trademarks*